US010843058B2

(12) United States Patent
Liao

(10) Patent No.: US 10,843,058 B2
(45) **Date of Patent: *Nov. 24, 2020**

(54) BASKETBALL SHOOTING TRAINING DEVICE

(71) Applicant: Chien-Yi Liao, Pingtung County (TW)

(72) Inventor: Chien-Yi Liao, Pingtung County (TW)

( * ) Notice: Subject to any disclaimer, the term of this patent is extended or adjusted under 35 U.S.C. 154(b) by 2 days.

This patent is subject to a terminal disclaimer.

(21) Appl. No.: 16/393,929

(22) Filed: Apr. 24, 2019

(65) Prior Publication Data

US 2019/0247730 A1 Aug. 15, 2019

Related U.S. Application Data

(63) Continuation-in-part of application No. 14/949,852, filed on Nov. 23, 2015, now Pat. No. 10,315,089.
(Continued)

(51) Int. Cl.
*A63B 69/00* (2006.01)
*A63B 43/00* (2006.01)
(Continued)

(52) U.S. Cl.
CPC ..... *A63B 69/0071* (2013.01); *A63B 5/16* (2013.01); *A63B 21/055* (2013.01);
(Continued)

(58) Field of Classification Search
CPC ..... A63B 69/091; A63B 69/0071; A63B 2208/0204; A63B 5/15; A63B 43/007; A63B 21/4005
See application file for complete search history.

(56) References Cited

U.S. PATENT DOCUMENTS 1,567,530 A * 12/1925 MacNaughton ... A63B 69/3641 473/229
2,652,250 A * 9/1953 Alder ..... A63B 69/0075 473/417
(Continued)

FOREIGN PATENT DOCUMENTS

CN 85 1 02082 B 10/1987
CN 2865792 Y 2/2007
(Continued)

OTHER PUBLICATIONS

"International Search Report" dated Jul. 23, 2019 for International application No. PCT/CN2019/084618, International filing date: Apr. 26, 2019.

*Primary Examiner* — Melba Bumgarner
*Assistant Examiner* — Amir A Klayman
(74) *Attorney, Agent, or Firm* — Winston Hsu

(57) ABSTRACT

A basketball shooting training device includes a main frame, a first vertical rail structure having vertical and oblique rails, a first sliding base, and a first basketball imitation member. The first vertical rail structure is disposed on the main frame. The first sliding base is slidably disposed on the first vertical rail structure for sliding along the first vertical rail structure. The first basketball imitation member is connected to the first sliding base. When the first basketball imitation member is propped and then propelled upwardly by a user's hand, the first sliding base slides from a first initial position on the vertical rail to a shooting position on the oblique rail for guiding the user's hand to complete a set shot along the first vertical rail structure.

20 Claims, 19 Drawing Sheets

Related U.S. Application Data

(60) Provisional application No. 62/663,272, filed on Apr. 27, 2018.

(51) Int. Cl.
*A63B 21/00* (2006.01)
*A63B 21/055* (2006.01)
*A63B 5/16* (2006.01)

(52) U.S. Cl.
CPC ..... *A63B 21/154* (2013.01); *A63B 43/007* (2013.01); *A63B 69/0057* (2013.01); *A63B 69/0059* (2013.01); *A63B 21/4005* (2015.10); *A63B 21/4009* (2015.10); *A63B 2208/0204* (2013.01); *A63B 2225/09* (2013.01)

(56) References Cited

U.S. PATENT DOCUMENTS 3,703,294 A * 11/1972 Fitch ..... A63B 69/3644 473/229
4,161,313 A * 7/1979 Dickey ..... A63B 69/0071 473/449
4,577,862 A * 3/1986 Sagedahl ..... A63B 21/0058 473/453
4,773,398 A * 9/1988 Tatom ..... A61H 1/0274 482/139
4,881,275 A * 11/1989 Cazares ..... A63B 71/148 2/161.1
5,135,217 A * 8/1992 Swain ..... A63B 69/0071 473/450
5,197,933 A * 3/1993 Waters ..... A63B 21/06 482/101
5,391,132 A * 2/1995 Greenwald ..... A63B 23/03533 482/114
7,572,209 B2 * 8/2009 Brennan ..... A63B 69/00 482/38
7,621,857 B2 * 11/2009 Pompile ..... A63B 21/0552 482/129
7,775,912 B2 * 8/2010 Aguirre ..... A63B 69/24 473/423
9,033,811 B2 * 5/2015 Bolling, Jr. ..... A63B 69/3661 473/221
9,914,034 B2 * 3/2018 Lee ..... A63B 69/0002
2005/0119071 A1 * 6/2005 Carbonero ..... A63B 41/08 473/422
2006/0003856 A1 * 1/2006 Bennett ..... A63B 69/0071 473/447
2008/0280705 A1 11/2008 LaPergola
2008/0300118 A1 * 12/2008 Wehrell ..... A63B 21/04 482/129
2015/0367219 A1 * 12/2015 Bibbens ..... A63B 69/0071 473/430
2016/0008650 A1 * 1/2016 Jue ..... A63B 22/02 482/54
2016/0243396 A1 * 8/2016 Taylor ..... G08C 17/02
2017/0144045 A1 5/2017 Liao

FOREIGN PATENT DOCUMENTS

CN 103691118 A 4/2014
CN 204485257 U 7/2015
CN 206434769 U 8/2017

* cited by examiner

BASKETBALL SHOOTING TRAINING DEVICE

CROSS REFERENCE TO RELATED APPLICATIONS

This application is a continuation in part of U.S. application Ser. No. 14/949,852 filed on Nov. 23, 2015, claims the benefit of U.S. Provisional Application No. 62/663,272, which was filed on Apr. 27, 2018, and is incorporated herein by reference.

BACKGROUND OF THE INVENTION

1. Field of the Invention

The present invention relates to a basketball shooting training device, and more specifically, to a basketball shooting training device for guiding a user's hand to complete a set shot along a vertical rail structure.

2. Description of the Prior Art

In general, proper shooting techniques could help a basketball player shoot a basketball into a basket successfully. One important technique is proper wrist motion. When the basketball player shoots the basketball, the basketball player needs to cock his wrist and then propel the basketball through the air into the basket. However, proper wrist motion is not enough if the basketball player could not properly position his lower arm at the same vertical plane with his upper arm while shooting the basketball. Thus, how to design a device to train a basketball player to develop both proper wrist motion and proper arm motion is one important issue in basketball shooting training.

SUMMARY OF THE INVENTION

The present invention provides a basketball shooting training device. The basketball shooting training device includes a main frame, a first vertical rail structure, a first sliding base, and a first basketball imitation member. The main frame is used for standing on a holding plane. The first vertical rail structure is disposed on the main frame. The first vertical rail structure has a vertical rail and an oblique rail. The oblique rail is connected to a top end of the vertical rail. The first sliding base has a first base member and a first arm member. The first base member jackets the first vertical rail structure and slidably contacts a first side of the first vertical rail structure for sliding along the first vertical rail structure. The first arm member extends from an outer edge of the first base member. The first basketball imitation member is connected to the first arm member. The first side of the first vertical rail structure faces the first basketball imitation member. When the first basketball imitation member is propped and then propelled upwardly by a user's hand, the first base member slides from a first initial position on the vertical rail to a shooting position on the oblique rail and keeps contacting the vertical rail without pivoting relative to the vertical rail to make the first basketball imitation member move straightly and upwardly along the vertical rail and then move straightly and obliquely along the oblique rail when the first base member slides along the first vertical rail structure for guiding the user's hand to complete a set shot along the first vertical rail structure.

The present invention further provides a basketball shooting training device. The basketball shooting training device includes a main frame, a first vertical rail structure, and a first basketball imitation member. The main frame is used for standing on a holding plane. The first vertical rail structure is disposed on the main frame. The first vertical rail structure has a vertical rail and an oblique rail. The oblique rail is connected to a top end of the vertical rail. The first basketball imitation member is slidably disposed on a first side of the first vertical rail structure. When the first basketball imitation member is propped and then propelled upwardly by a user's hand, the first basketball imitation member slides from an initial position on the vertical rail to a shooting position on the oblique rail to move straightly and upwardly along the vertical rail and then move straightly and obliquely along the oblique rail, for guiding the user's hand to complete a set shot along the first vertical rail structure.

These and other objectives of the present invention will no doubt become obvious to those of ordinary skill in the art after reading the following detailed description of the preferred embodiment that is illustrated in the various figures and drawings.

DETAILED DESCRIPTION

Figure 1:
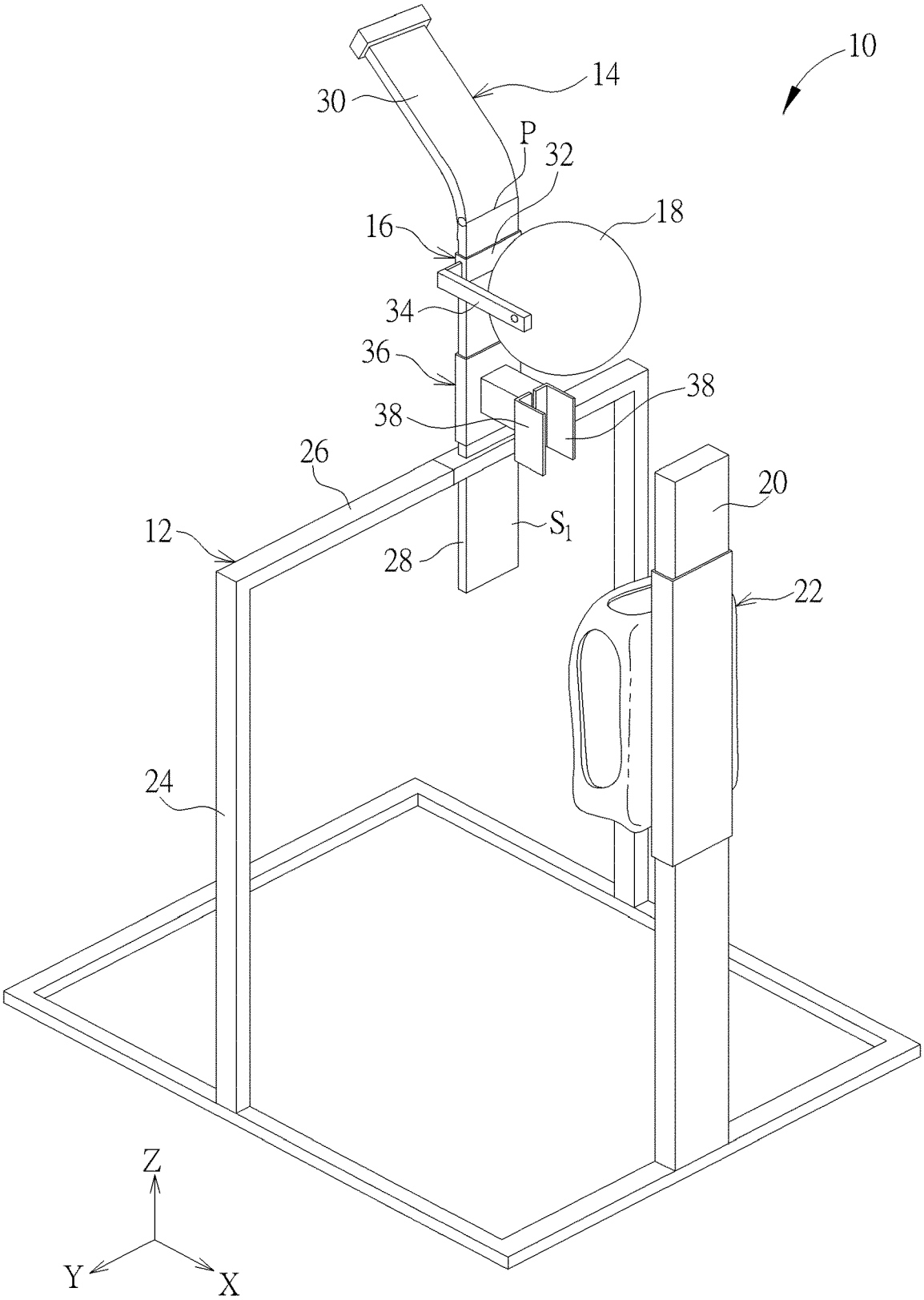
FIG. 1 is a diagram of a basketball shooting training device according to an embodiment of the present invention.

Please refer to FIG. 1, which is a diagram of a basketball shooting training device 10 according to an embodiment of the present invention. As shown in FIG. 1, the basketball shooting training device 10 includes a main frame 12, a first vertical rail structure 14, a first sliding base 16, a first basketball imitation member 18, a second vertical rail structure 20, and a torso attachment member 22. The main frame 12 has a standing frame portion 24 and a transverse frame portion 26. The transverse frame portion 26 is connected to the standing frame portion 24, and the standing frame portion 24 is used for standing on a holding plane (such as a ground plane) so that the basketball shooting training device 10 could be placed steadily on the holding plane for a user (e.g. a basketball player) to operate conveniently. The first vertical rail structure 14 is disposed on the transverse frame portion 26 and has a vertical rail 28 and an oblique rail 30 connected to a top end P of the vertical rail 28. In this embodiment, the oblique rail 30 is preferably pivoted to the top end P of the vertical rail 28 (e.g. by a hinge, but not limited thereto), so that the user could properly adjust his shooting angle by adjusting an oblique angle of the oblique rail 30 relative to the vertical rail 28.

The first sliding base 16 has a first base member 32 and a first arm member 34. The first base member 32 is slidably disposed on a first side $S_1$ of the first vertical rail structure 14 for sliding along the first vertical rail structure 14. The first arm member 34 extends from the first base member 32. The first basketball imitation member 18 is connected to the first arm member 34 so that the user could prop the first basketball imitation member 18 by his shooting hand for performing a shooting motion. In practical application, the weight of the first basketball imitation member 18 could be increased by adding fillers (e.g. water or sand) into the first basketball imitation member 18 for achieving the muscles training purpose.

Furthermore, the second vertical rail structure 20 is spaced apart from the main frame 12 and is connected to the standing frame portion 24. The torso attachment member 22 is slidably disposed on the second vertical rail structure 20 for attaching to the user's torso so as to guide the user's torso to move vertically along the second vertical rail structure 20, so as to improve the postural stability of the user when the user performs a shooting motion. In this embodiment, the torso attachment member 22 could be a wearable equipment (e.g. a wearable vest), but not limited thereto. That is, in another embodiment, the present invention could adopt other attachment equipment (e.g. a lap-shoulder harness) which could be attached to the user's torso. To be noted, the second vertical rail structure 20 and the torso attachment member 22 could be omissible components for simplifying the mechanical design of the basketball shooting training device 10.

Furthermore, for ensuring that the user could properly position his lower arm at the same vertical plane with his upper arm while propping and then propelling the first basketball imitation member 18 upwardly by his shooting hand, as shown in FIG. 1, the basketball shooting training device 10 could further include an arm guide base 36. The arm guide base 36 is disposed on the first side $S_1$ of the first vertical rail structure 14 and located under the first sliding base 16. The arm guide base 36 has two guide sheets 38 spaced apart thereon for constraining the user's lower arm put therebetween at the same vertical plane with the user's upper arm. In practical application, the two guide sheets 38 could be movably disposed on the arm guide base 36 and the first vertical rail structure 14 could be movable leftward and rightward and pivotable forward and rearward relative to the transverse frame portion 26, so that the user could conveniently adjust positions of the two guide sheets 38 relative to the user for aligning the user's lower arm with the user's upper arm at the same vertical plane. As for the related description for the mechanical designs for making the two guide sheets 38 movably disposed on the arm guide base 36 and making the first vertical rail structure 14 disposed on the transverse frame portion 26 movably and pivotably, it is commonly seen in the prior art and omitted herein. Moreover, in another embodiment, the vertical rail 28 could be an arc-shaped rail instead of a linear rail as shown in FIG. 1, for helping the user complete a set shot along the first vertical rail structure 14 more smoothly.

Figure 2:
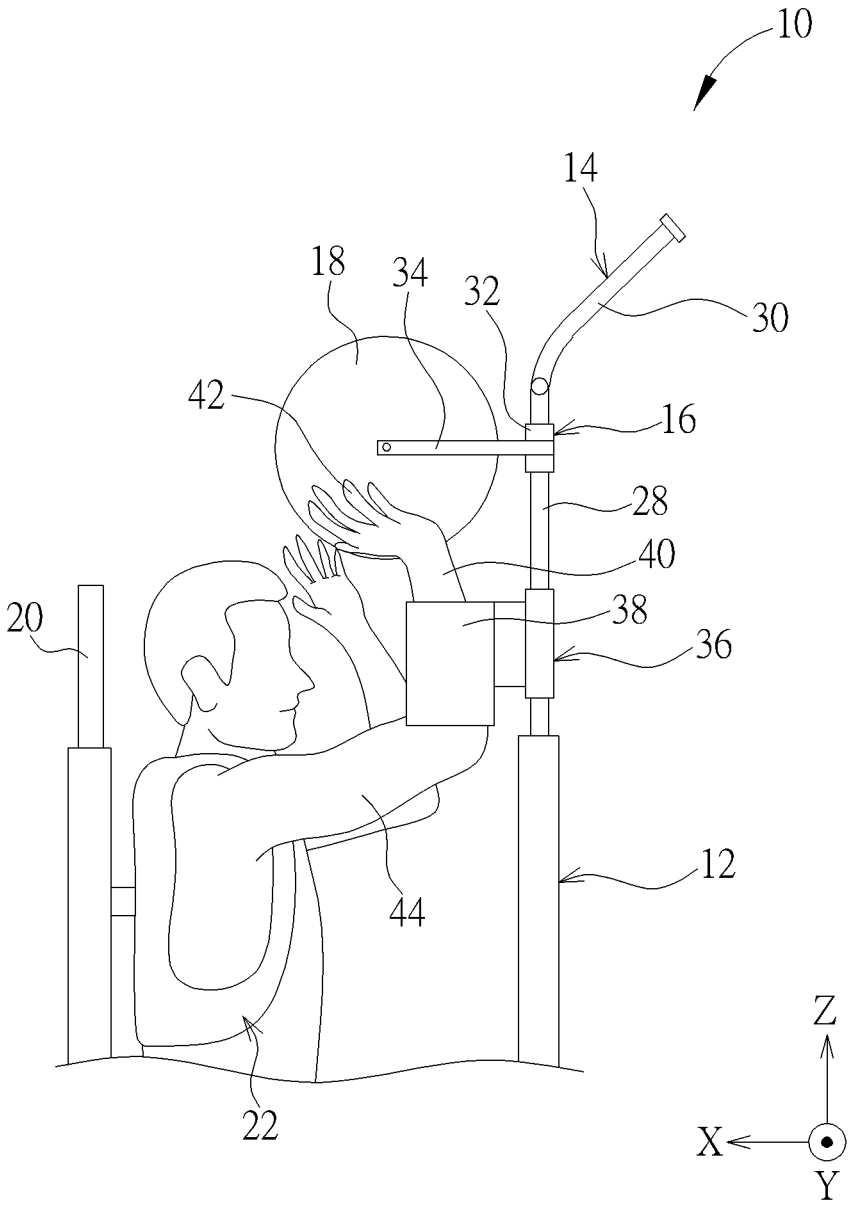
FIG. 2 is a side view of a user wearing a torso attachment member and propping a first basketball imitation member at a knee bending position.
Figure 3:
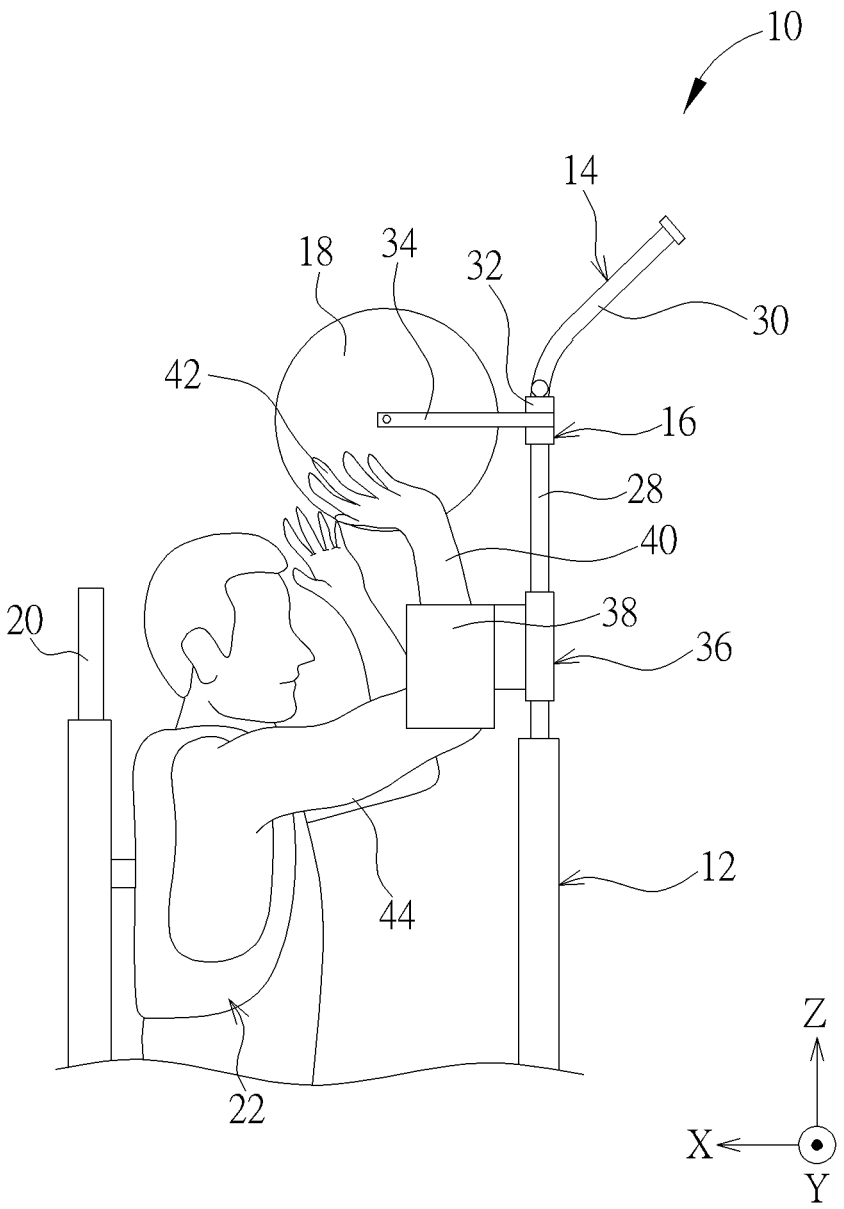
FIG. 3 is a side view of the torso attachment member in FIG. 2 guiding the user's torso to move vertically to a first initial position along a second vertical rail structure.
Figure 4:
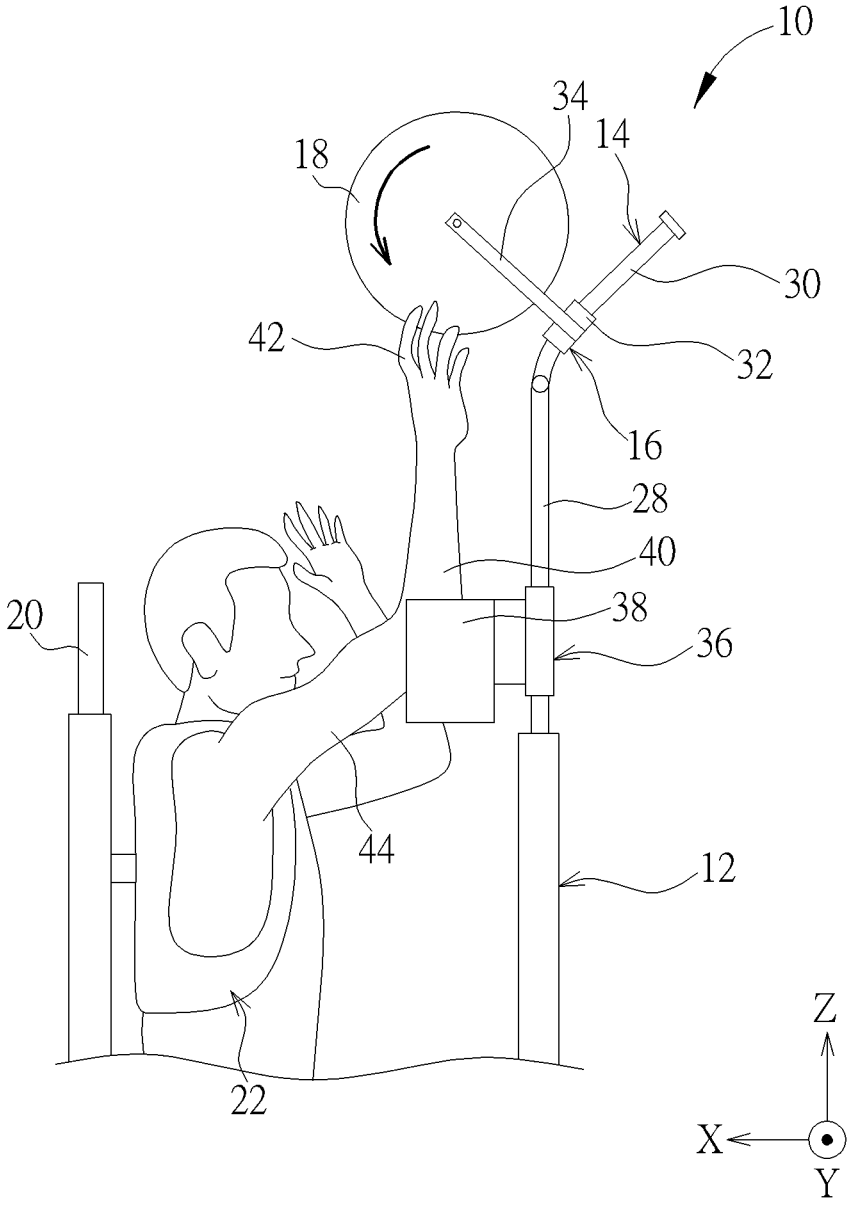
FIG. 4 is a side view of a first base member in FIG. 3 sliding to a shooting position on an oblique rail portion.

More detailed description for operating the basketball shooting training device 10 is provided as follows. Please refer to FIG. 2, FIG. 3, and FIG. 4. FIG. 2 is a side view of a user wearing the torso attachment member 22 and propping the first basketball imitation member 18 at a knee bending position. FIG. 3 is a side view of the torso attachment member 22 in FIG. 2 guiding the user's torso to move vertically to a first initial position along the second vertical rail structure 20. FIG. 4 is a side view of the first base member 32 in FIG. 3 sliding to a shooting position on the oblique rail 30. After the user wears the torso attachment member 22, the user could put his lower arm 40 between the two guide sheets 38, prop the first basketball imitation member 18 by his shooting hand 42, and then adjust positions of the two guide sheets 38 relative to the user by properly moving the first vertical rail structure 14 leftward and rightward and pivoting the first vertical rail structure 14 forward and rearward for aligning the user's lower arm 40 with the user's upper arm 44 at the same vertical plane (i.e. an XZ plane shown in FIG. 2). After that, the user could bend his knee to perform a ready action at the knee bending position as shown in FIG. 2 for basketball shooting. Subsequently, the torso attachment member 22 could guide the user's torso to move vertically from the knee bending position as shown in FIG. 2 to the first initial position as shown in FIG. 3 along the second vertical rail structure 20 when the user stretches his knee, and then the user could propel the first basketball imitation member 18 upwardly by his shooting hand 42 to make the first base member 32 slides from the first initial position as shown in FIG. 3 on the vertical rail 28 to the shooting position as shown in FIG. 4 on the oblique rail 30.

To be noted, in this embodiment, the first basketball imitation member 18 could be rotatably connected to the first arm member 34 (e.g. by connecting the first basketball imitation member 18 to the first arm member 34 via a torsional spring) for allowing the user's fingers to rotate the first basketball imitation member 18 counterclockwise at a specific angle (e.g. 30°, but not limited thereto) when the first base member 32 slides to the shooting position as shown in FIG. 4 on the oblique rail 30, so as to make the user's fingers complete a follow-through motion.

In such a manner, the basketball shooting training device 10 could guide the user's shooting hand 42 to complete a set shot along the first vertical rail structure 14 in the case of his lower arm 40 positioned at the same vertical plane with his upper arm 44, so that the basketball shooting training device 10 could train the user to develop both proper wrist motion and proper arm motion for shooting a basketball into a basket successfully as well as achieve the motion restriction purpose as the user repeatedly performs the aforesaid basketball shooting training process.

Moreover, since the first base member 32 could slide from the shooting position on the oblique rail 30 back to the first initial position on the vertical rail 28 due to the weight of the first basketball imitation member 18 while the first basketball imitation member 18 is not propped by the user's shooting hand 42, the present invention could further adopt a braking design for stopping the first base member 32 at the first initial position, so as to efficiently prevent the first basketball imitation member 18 from dropping fast to accidentally cause damage to the user. That is, the basketball shooting training device 10 could further include a braking device 46 disposed on the first sliding base 16 for braking the first sliding base 16 when the first base member 32 slides from the shooting position on the oblique rail 30 back to the first initial position on the vertical rail 28.

Figure 5:
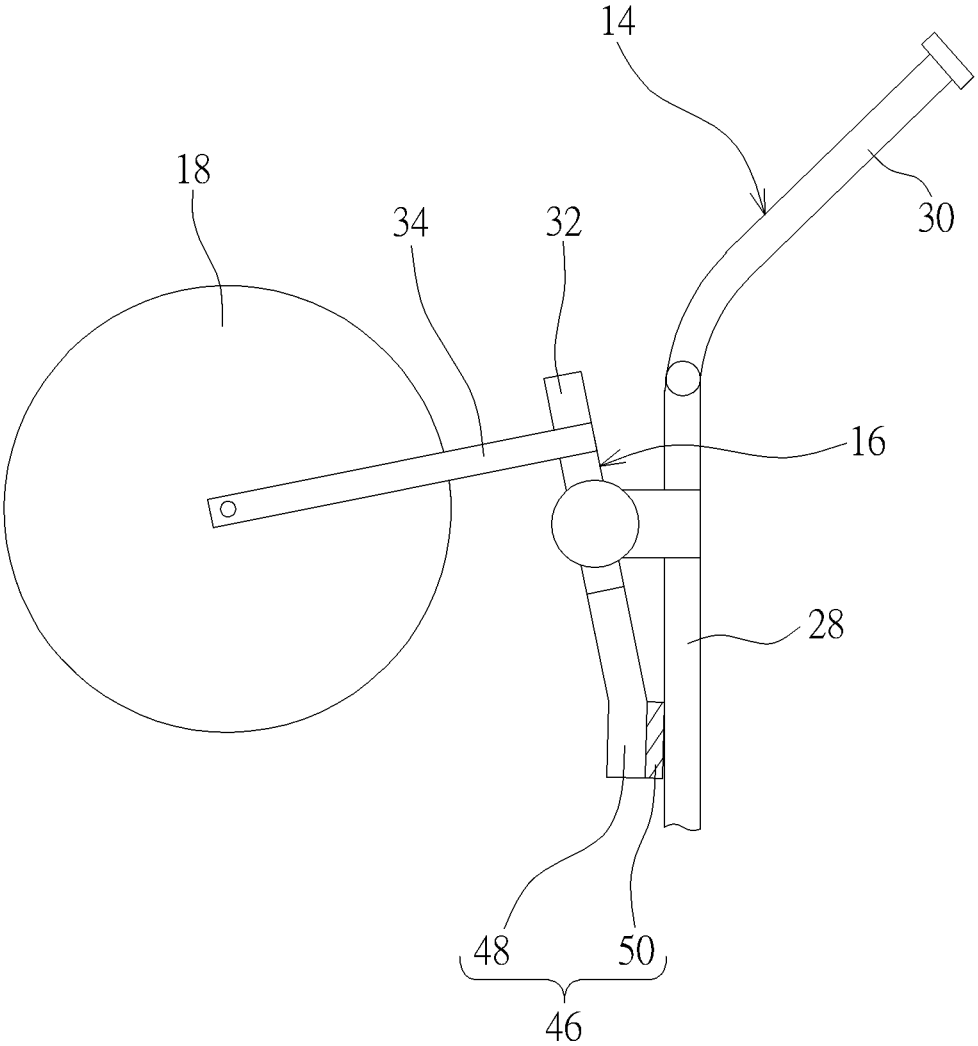
FIG. 5 is a side view of a braking device being disposed on a first sliding base according to another embodiment of the prevent invention.
Figure 6:
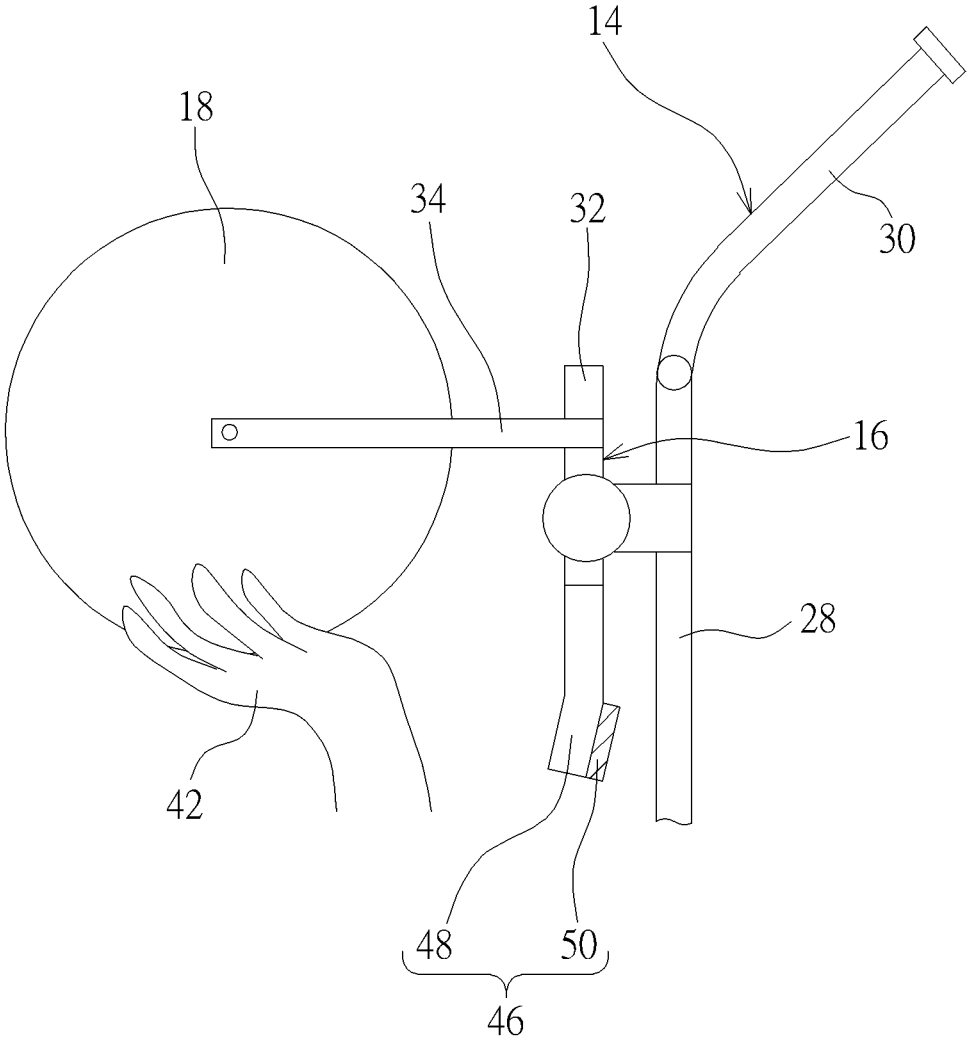
FIG. 6 is a side view of the first sliding base pivoting relative to a first vertical rail structure to make the braking device separate from the first vertical rail structure.

For example, please refer to FIG. 5 and FIG. 6. FIG. 5 is a side view of the braking device 46 being disposed on the first sliding base 16 according to another embodiment of the prevent invention. FIG. 6 is a side view of the first sliding base 16 pivoting relative to the first vertical rail structure 14 to make the braking device 46 separate from the first vertical rail structure 14. Components both mentioned in this embodiment and the aforesaid embodiment represent components with similar structures or functions, and the related description is omitted herein.

As shown in FIG. 5 and FIG. 6, in this embodiment, the first sliding base 16 could be pivoted to the first vertical rail structure 14, and the braking device 46 could include a bending arm 48 and a braking pad 50. The bending arm 48 extends from the first base member 32. The braking pad 50 is disposed at a bottom end of the bending arm 48. Accordingly, as shown in FIG. 5, the first sliding base 16 could pivot relative to the first vertical rail structure 14 cooperatively with the bending arm 48 due to the weight of the first basketball imitation member 18 to make the braking pad 50 contact with the first vertical rail structure 14 for stopping the first sliding base 16 at the first initial position when the first basketball imitation member 18 is not propped. On the other hand, as shown in FIG. 6, when the first basketball imitation member 18 is propelled upwardly by the user's shooting hand 42, the first sliding base 16 could pivot relative to the first vertical rail structure 14 cooperatively with the bending arm 48 to make the braking pad 50 separate from the first vertical rail structure 14, so that the user could continue propelling the first basketball imitation member 18 upwardly. Via the aforesaid braking design, the operational safety of the basketball shooting training device 10 could be greatly improved.

Figure 7:
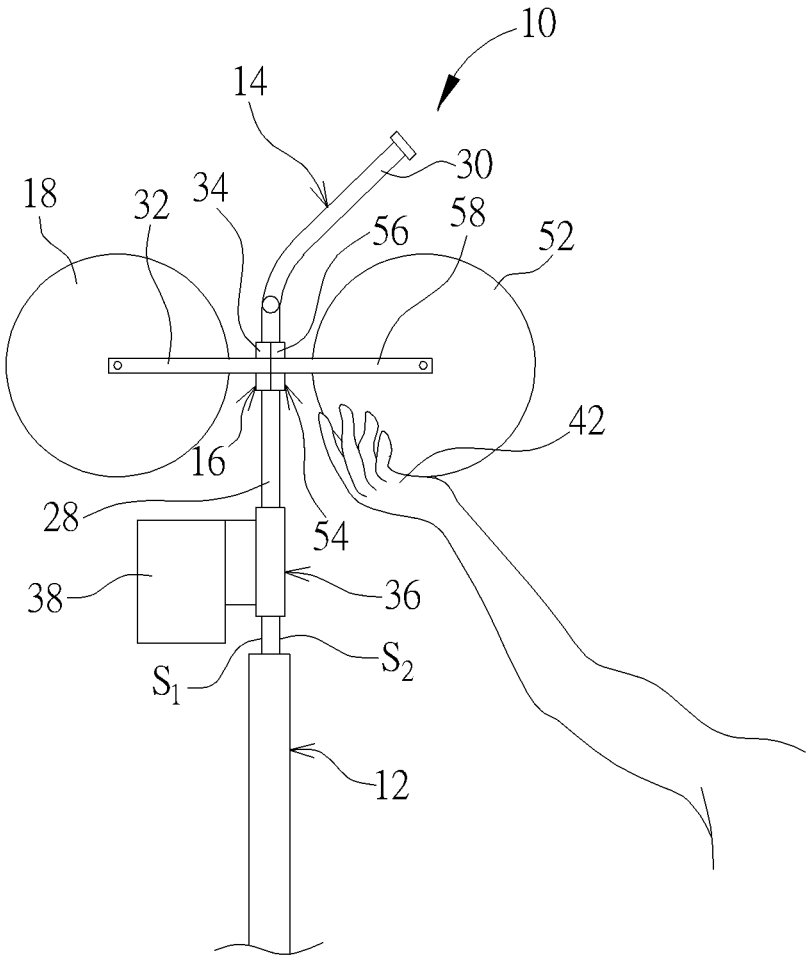
FIG. 7 is a side view of the user's shooting hand propping a second basketball imitation member according to another embodiment of the present invention.
Figure 8:
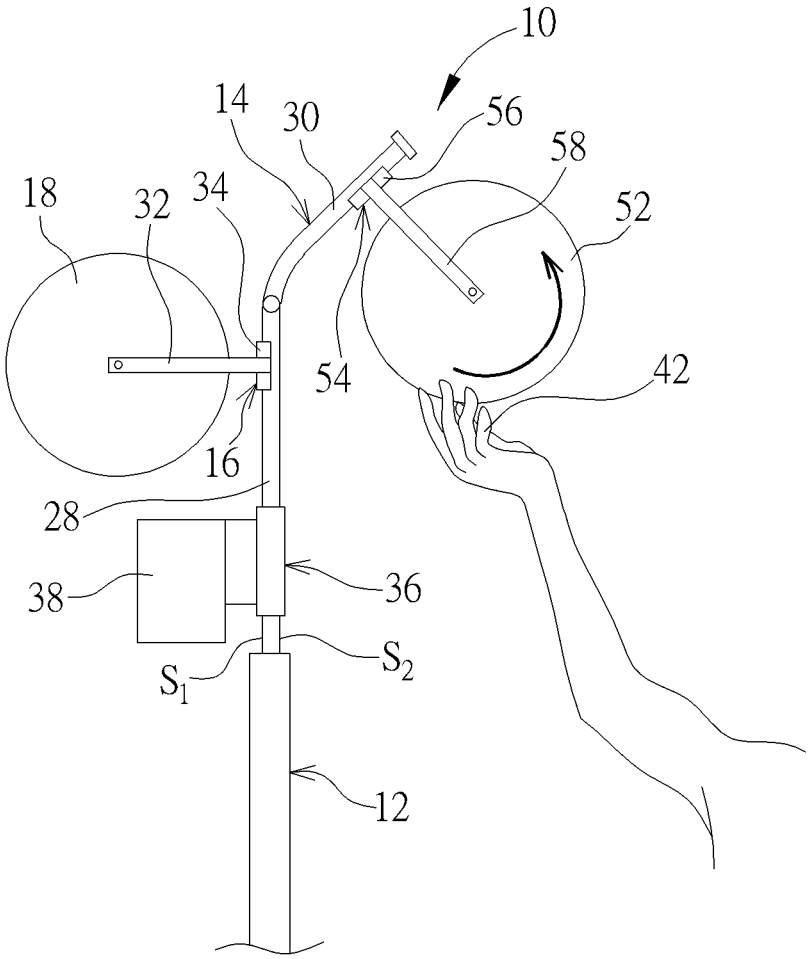
FIG. 8 is a side view of the user's shooting hand propelling the second basketball imitation member in FIG. 7 upwardly to complete a hook shot.

It should be mentioned that the basketball shooting training device 10 could further have a hook shot training function. Please refer to FIG. 7 and FIG. 8. FIG. 7 is a side view of the user's shooting hand 42 propping a second basketball imitation member 52 according to another embodiment of the present invention. FIG. 8 is a side view of the user's shooting hand 42 propelling the second basketball imitation member 52 in FIG. 7 upwardly to complete a hook shot. Components both mentioned in this embodiment and the aforesaid embodiment represent components with similar structures or functions, and the related description is omitted herein.

As shown in FIG. 7 and FIG. 8, in this embodiment, the basketball shooting training device 10 could further include the second basketball imitation member 52 and a second sliding base 54. The second sliding base 54 has a second base member 56 and a second arm member 58. The second base member 56 is slidably disposed on a second side $S_2$ of the first vertical rail structure 14 opposite to the first base member 32 for sliding along the first vertical rail structure 14. The second arm member 58 extends from the second base member 56. The second basketball imitation member 52 could be connected to the second arm member 58 so that the user could prop the second basketball imitation member 52 with his shooting hand for performing a hooking motion. In practical application, the weight of the second basketball imitation member 52 could be increased by adding fillers (e.g. water or sand) into the second basketball imitation member 52 for achieving the muscles training purpose.

Furthermore, in this embodiment, the second basketball imitation member 52 could be rotatably connected to the second arm member 58 (e.g. by connecting the second basketball imitation member 52 to the second arm member 58 via a torsional spring) for allowing the user's fingers to rotate the second basketball imitation member 52 at a specific angle (e.g. 30% but not limited thereto) when the second base member 56 slides to a hooking position as shown in FIG. 8 on the oblique rail 30, so as to make the user's fingers complete a follow-through motion.

To be noted, the aforesaid arm positioning design could also be applied to this embodiment for positioning the user's lower arm at the same vertical plane with the user's upper arm while propping and then propelling the second basketball imitation member 52 upwardly by the user's shooting hand. The related description could be reasoned by analogy according to the aforesaid embodiment and be omitted herein.

In such a manner, the user could prop and then propel the second basketball imitation member 52 upwardly by his shooting hand 42 to make the second base member 58 slide from a second initial position as shown in FIG. 7 on the vertical rail 28 to the hooking position as shown in FIG. 8 on the oblique rail 30, so as to complete a hook shot along the first vertical rail structure 14. Accordingly, the basketball shooting training device 10 could train the user to develop both proper wrist motion and proper arm motion for hooking a basketball into a basket successfully as well as achieve the motion restriction purpose as the user repeatedly performs the aforesaid basketball hooking training process.

Figure 9:
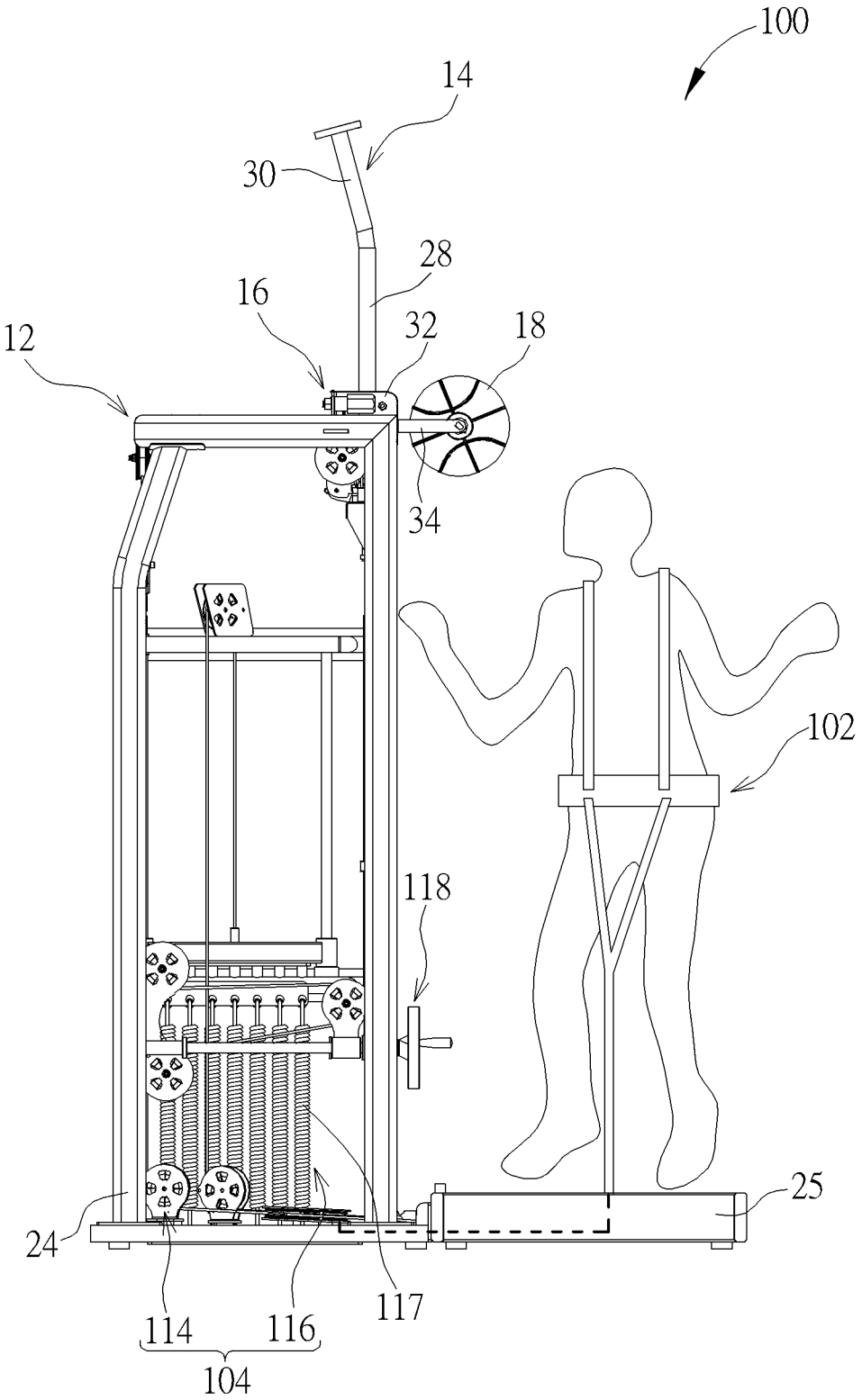
FIG. 9 is a side view of a basketball shooting training device according to another embodiment of the present invention.
Figure 10:
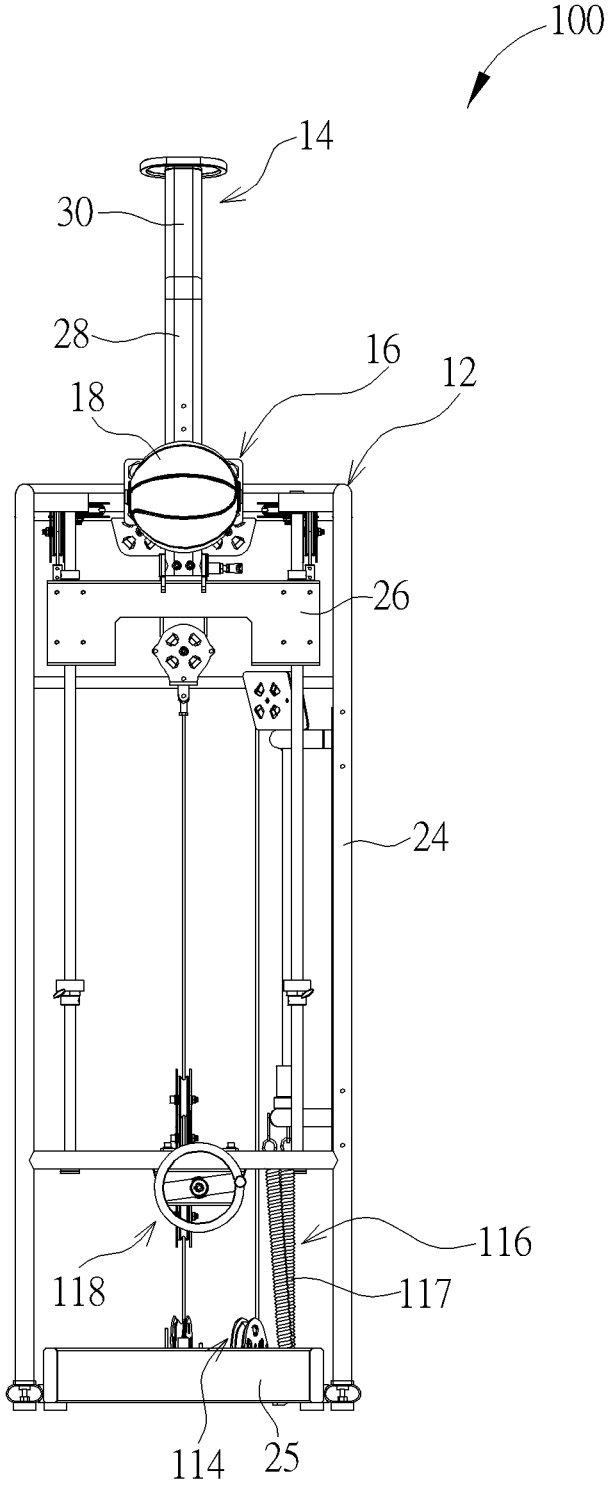
FIG. 10 is a front view of the basketball shooting training device in FIG. 9.
Figure 11:
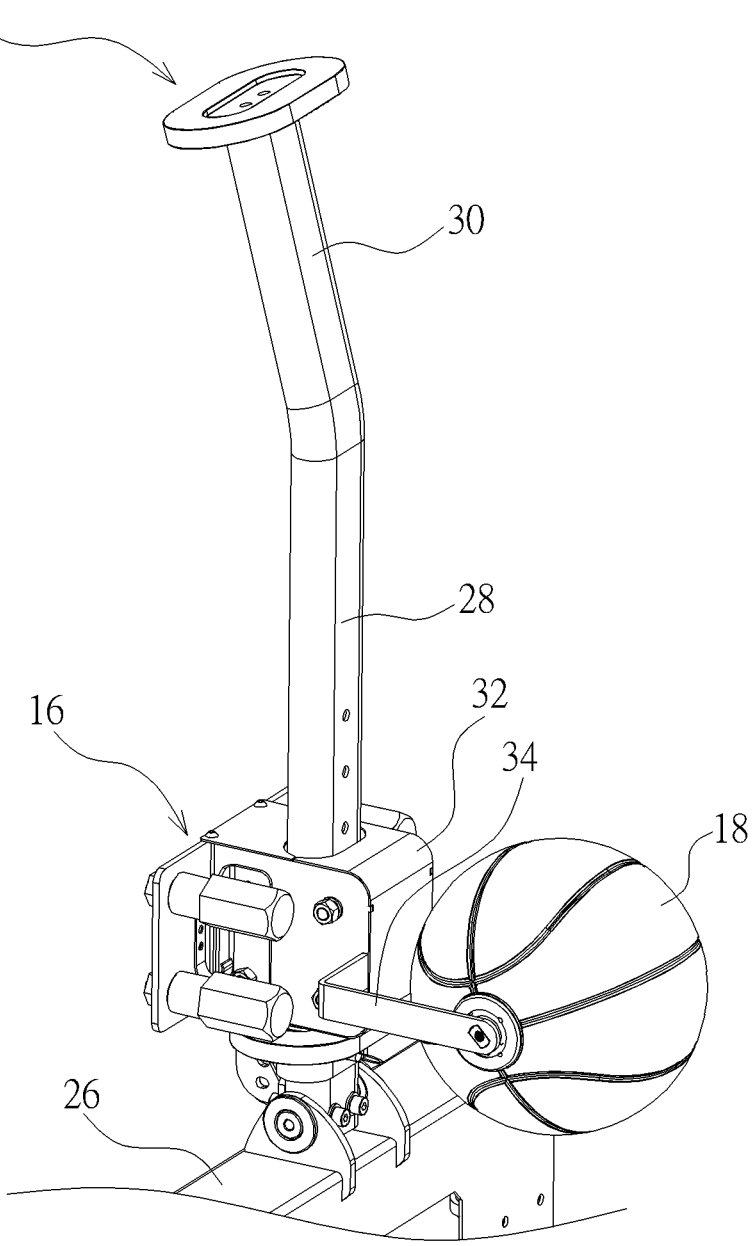
FIG. 11 is an enlarged diagram of the first vertical rail structure, the first sliding base, and the first basketball imitation member in FIG. 9.

In addition, please refer to FIGS. 9-11. FIG. 9 is a side view of a basketball shooting training device 100 according to another embodiment of the present invention. FIG. 10 is a front view of the basketball shooting training device 100 in FIG. 9. FIG. 11 is an enlarged diagram of the first vertical rail structure 14, the first sliding base 16, and the first basketball imitation member 18 in FIG. 9. Components both mentioned in this embodiment and the aforesaid embodiments represent components with similar structures or functions, and the related description is omitted herein.

As shown in FIGS. 9-11, the basketball shooting training device 100 includes the main frame 12, the first vertical rail structure 14, the first sliding base 16, the first basketball imitation member 18, a torso attachment member 102, and a pulley transmission device 104. The main frame 12 has the standing frame portion 24 and the transverse frame portion 26. The transverse frame portion 26 is slidable upwardly and downwardly along the standing frame portion 24 for adjusting the first basketball imitation member 18 to a desired height (e.g. the first basketball imitation member 18 could be adjusted to be aligned with a user's forehead or nose). The main frame 12 could further have a standing base 25. The standing base 25 extends laterally from the standing frame portion 24 for allowing a user to stand thereon and then perform the related training operations of the basketball shooting training device 100. The first vertical rail structure 14 is disposed on the transverse frame portion 26 and has the vertical rail 28 and the oblique rail 30 connected to the vertical rail 28. In this embodiment, the oblique rail 30 is preferably pivotally connected to the vertical rail 28 (e.g. by a hinge, but not limited thereto), so that the user could properly adjust his shooting angle by adjusting an oblique angle (preferably 10°~30°) of the oblique rail 30 relative to the vertical rail 28. Furthermore, the first vertical rail structure 14 could be pivotable forwardly relative to the transverse frame portion 26 (as shown in FIG. 11), so that the user could conveniently adjust his shooting angle by adjusting an oblique angle (preferably 45°~90°) of the first vertical rail structure 14 relative to the transverse frame portion 26.

To be noted, in this embodiment, the first sliding base 16 is an omissible component for simplifying the structural design of the basketball shooting training device 100 provided by the present invention. For example, in another embodiment, the first vertical rail structure could be a hollow rail tube and the first basketball imitation member could be movably disposed within the first vertical rail structure, so as to make the first basketball imitation member slide along the first vertical rail structure without the first sliding base.

Figure 12:
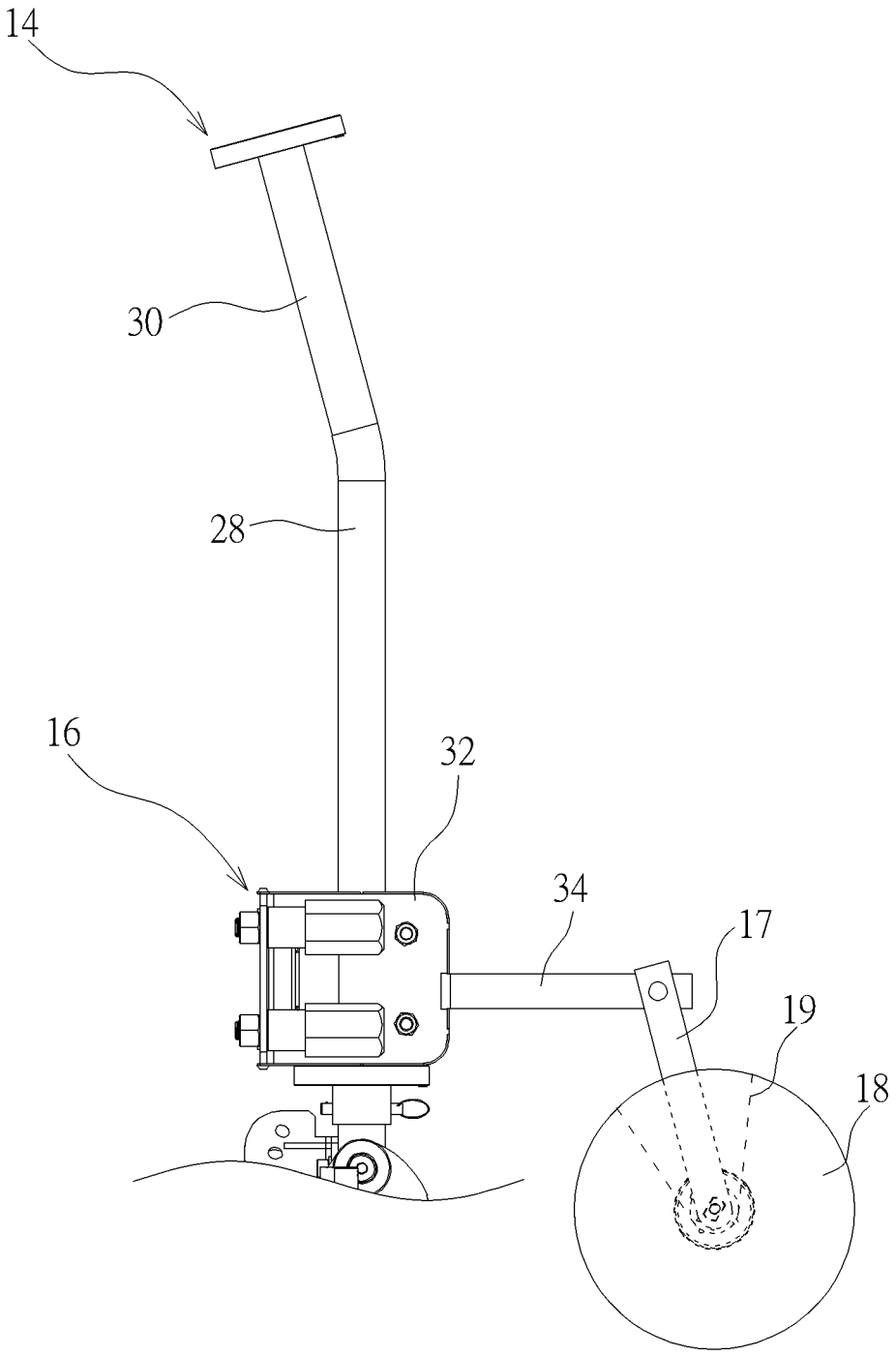
FIG. 12 is a side view of the first basketball imitation member being connected to the first arm member via a limiting rod according to another embodiment of the present invention.

It should be mentioned that an angle limiting design could be further applied to the first basketball imitation member 18 and the first arm member 34. For example, as shown in FIG. 12, the first sliding base 16 could further have a limiting rod 17 pivotally connected to the first arm member 34. The limiting rod 17 penetrates into the first basketball imitation member 18 via a limiting slot 19 of the first basketball imitation member 18 and is pivotally connected to the first basketball imitation member 18, so as to limit rotation of the first basketball imitation member 18 in a proper angle range (preferably) 30° ~60° for efficiently preventing the user from slipping the first basketball imitation member 18 off his shooting hand.

Figure 13:
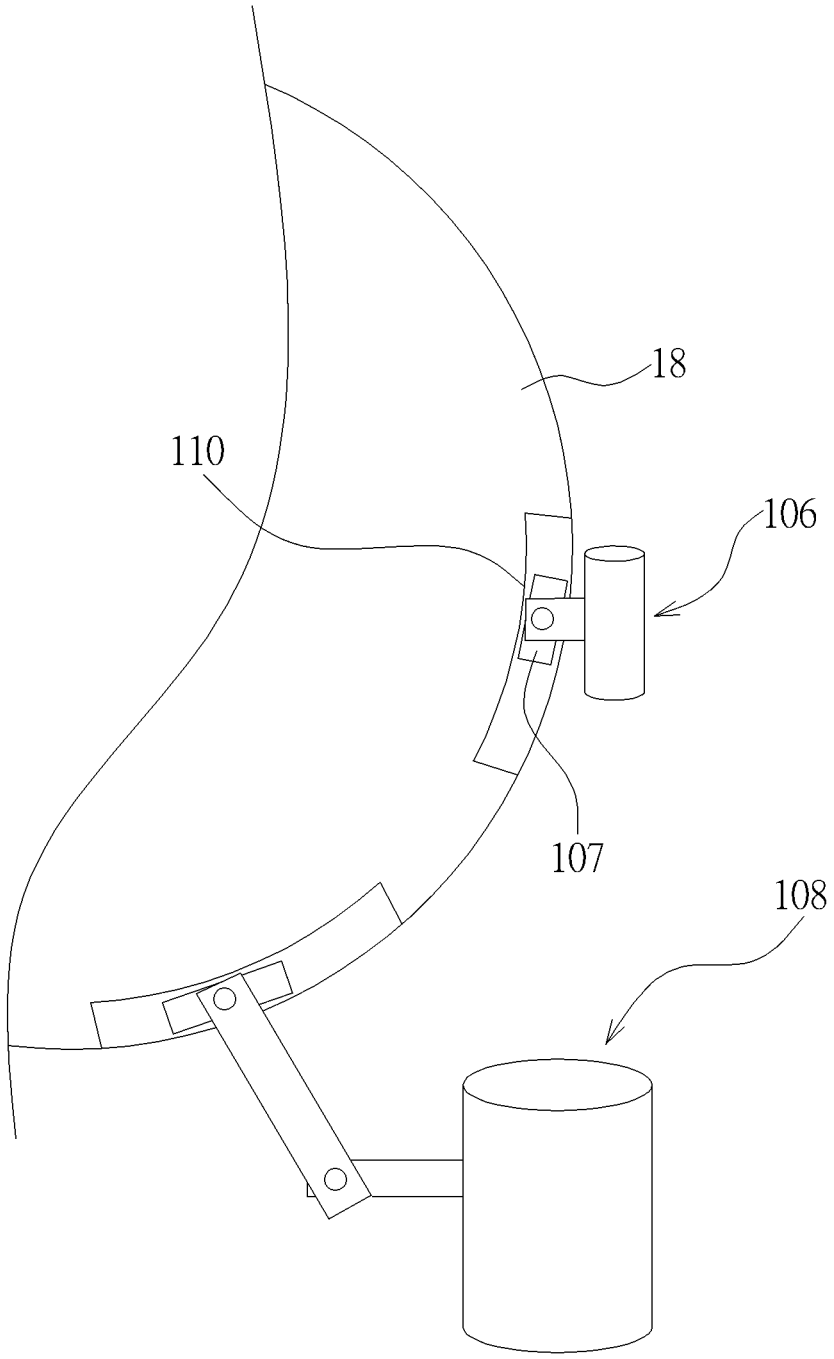
FIG. 13 is a diagram of a finger attachment device and a wrist attachment device being movably disposed on the first basketball imitation member in FIG. 9.
Figure 14:
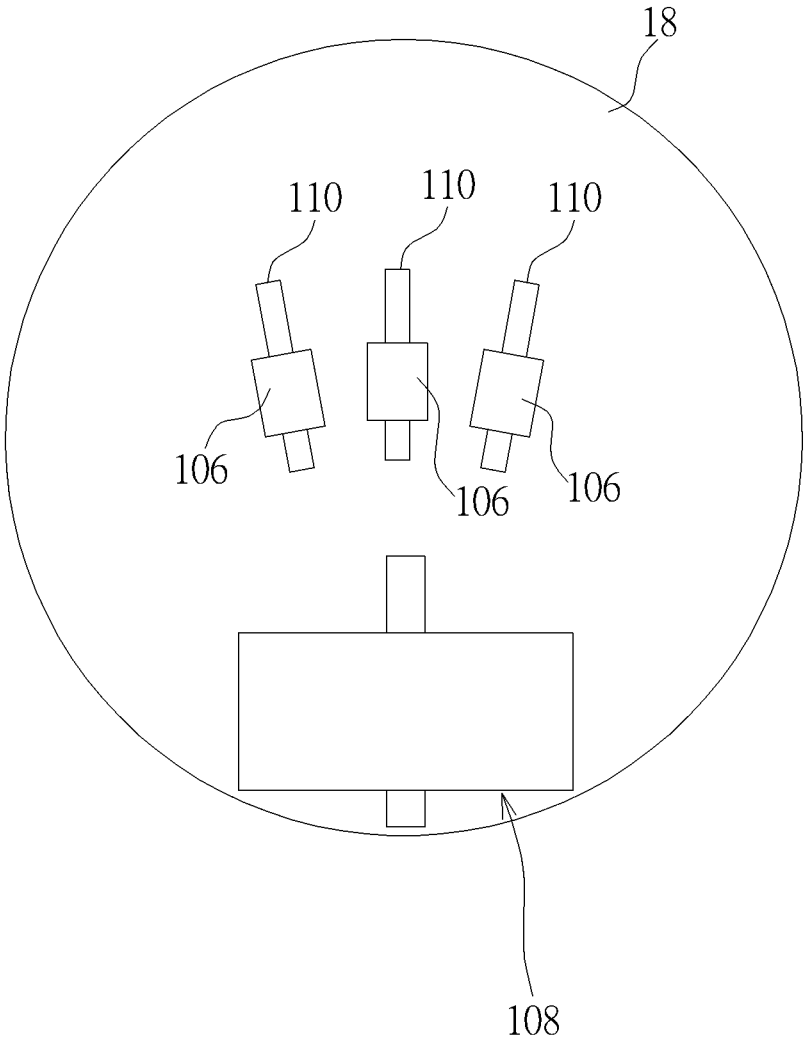
FIG. 14 is a top view of the finger attachment device and the wrist attachment device in FIG. 13 being movably disposed on the first basketball imitation member.

In practical application, an attachment design could be further applied to the first basketball imitation member 18 for ensuring that the user can put his fingers on the first basketball imitation member 18 at the right position firmly. As shown in FIGS. 13-14, the basketball shooting training device 100 could further include at least one finger attachment device 106 (preferably three Velcro straps as shown in FIG. 14, but not limited thereto) and a wrist attachment device 108 (preferably a wristband as shown in FIG. 13, but not limited thereto). The finger attachment device 106 and the wrist attachment device 108 are movably disposed on the first basketball imitation member 18. For example, as shown in FIG. 13 and FIG. 14, the first basketball imitation member 18 could have a linear guide rail 110 formed thereon and the finger attachment device 106 could have a sliding block 107 slidably disposed in the linear guide rail 110, so as to make the finger attachment device 106 slidable along the linear guide rail 110 via the sliding block 107. In such a manner, the user can attach his fingers (e.g. the forefinger, the middle finger, and the ring finger) to the finger attachment devices 106 respectively and attach his wrist to the wrist attachment device 108, and then can adjust the finger attachment devices 106 and the wrist attachment device 108 to the right positions for helping the user spread his fingers at a desired angle while the user lifts the first basketball imitation member 18 by his shooting hand.

Figure 15:
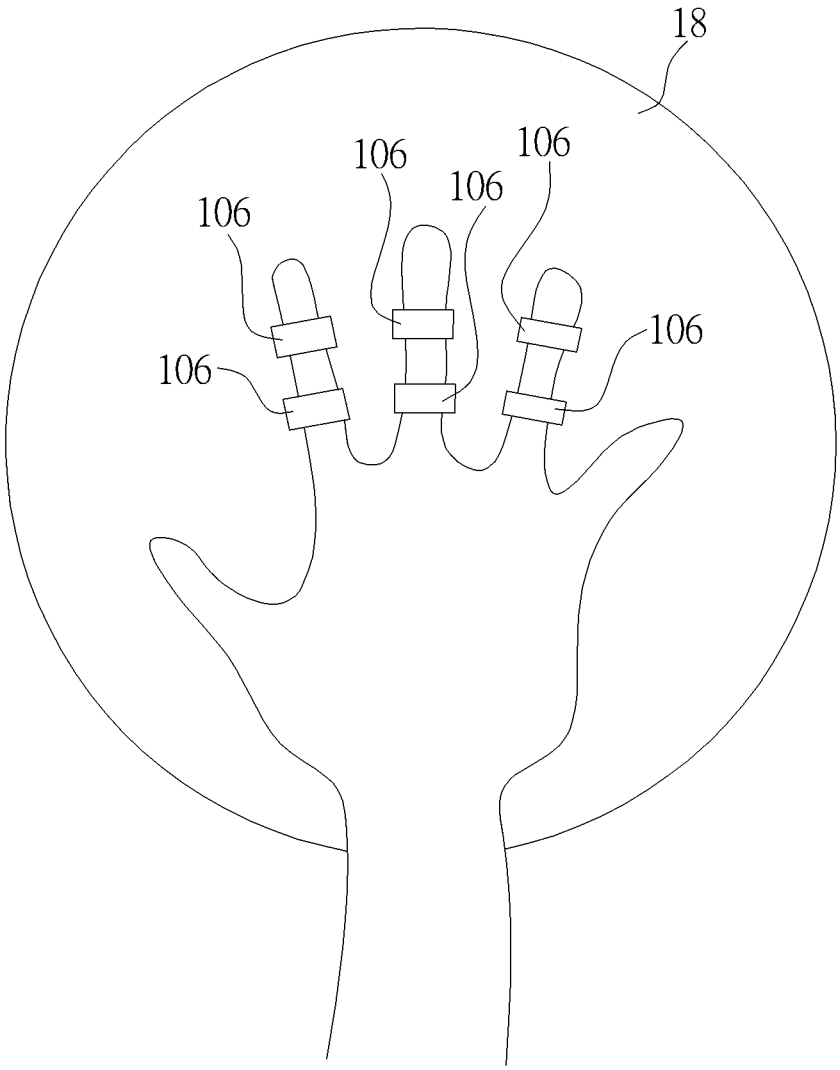
FIG. 15 is a top view of the finger attachment device in FIG. 13 being movably disposed on the first basketball imitation member according to another embodiment of the present invention.
Figure 16:
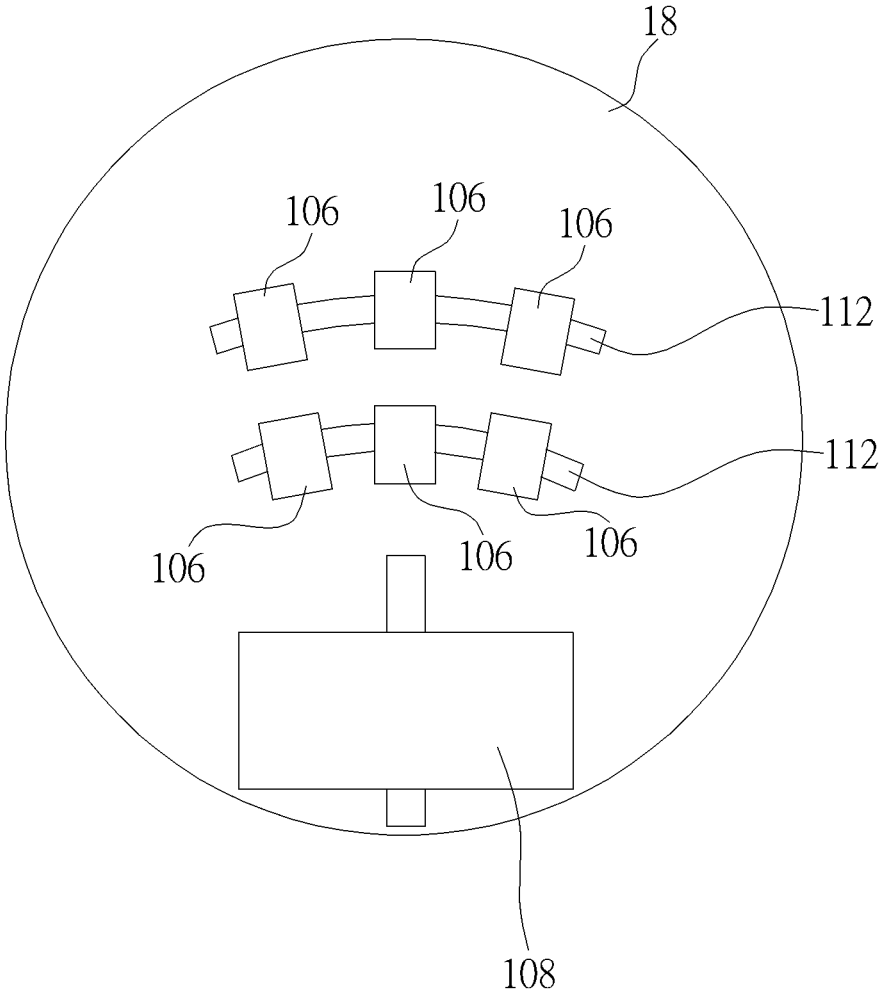
FIG. 16 is a top view of the finger attachment device in FIG. 13 being slidable along an arc-shaped guide rail according to another embodiment of the present invention.

To be noted, as shown in FIG. 15, the present invention could further utilize two finger attachment devices 106 to attach the user's forefinger, middle finger, and ring finger on the first basketball imitation member 18 respectively for ensuring that the user can put his fingers on the first basketball imitation member 18 at the right position more firmly. Furthermore, as shown in FIG. 16, in another embodiment, each two finger attachment devices 106 for one finger could be slidable along two arc-shaped guide rails 112 respectively, so as to make adjustment for finger attachment more flexibly and conveniently.

Moreover, as shown in FIG. 9, the torso attachment member 102 is connected to the pulley transmission device 104 and is attached to the user's torso for guiding the user's torso to move vertically, so as to improve the postural stability of the user when the user performs a shooting motion. In this embodiment, the torso attachment member 102 could be a wearable belt equipment (e.g. a lap-shoulder harness as shown in FIG. 9) which could be attached to the user's torso. Further, as shown in FIGS. 9-10, the pulley transmission device 104 is disposed on the standing frame portion 24 and includes a pulley assembly 114 and a pulling force applying device 116 (preferably composed of seven tension springs 117 as shown in FIG. 9, but not limited thereto, meaning that the present invention could adopt other designs for providing pulling force, such as connecting the pulley assembly 114 to a plurality of weight plates). The pulley assembly 114 is connected to the transverse frame portion 26 and the torso attachment member 102 respectively, so as to make the transverse frame portion 26 and the torso attachment member 102 move together via transmission of the pulley assembly 114. As for the pulley transmission design of the pulley assembly 114, the related description is commonly seen in the prior art and omitted herein.

After the user wears the torso attachment member 102, the user could prop the first basketball imitation member 18 by his shooting hand. After that, the user could bend his knee to perform a ready action for basketball shooting. Subsequently, the torso attachment member 102 could guide the user's torso to move vertically when the user stretches his knee (during this process, tension of the tension pulling force applying device 116 could be increased for achieving the torso and foot muscles training purpose), and then the user could propel the first basketball imitation member 18 upwardly by his shooting hand to make the first base member 32 slide from the vertical rail 28 to the oblique rail 30 for completing a set shot.

In practical application, as shown in FIGS. 9-10, the present invention could further utilize a wheel handle device 118 to be connected to the pulley assembly 114 for adjusting the steel cable length of the pulley assembly 114, so as to drive the transverse frame portion 26 slide upwardly or downwardly along the standing frame portion 24 to independently adjust the first basketball imitation member 18 to a desired height (e.g. the first basketball imitation member 18 could be adjusted to be aligned with a user's forehead or nose).

Figure 17:
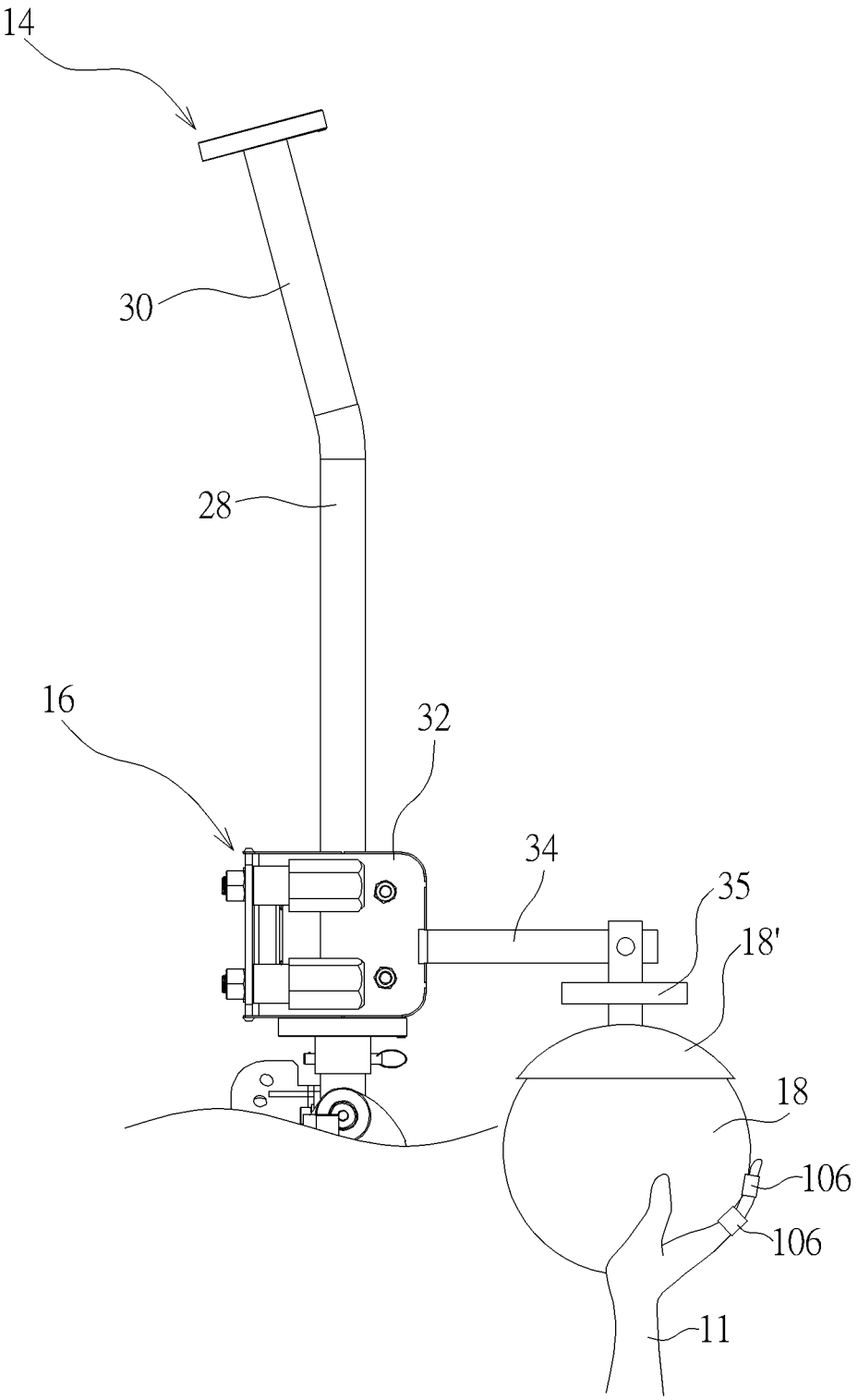
FIG. 17 is a side view of a basketball imitation member being connected to the first arm member according to another embodiment of the present invention.

Furthermore, the present invention could adopt other basketball imitation design. For example, please refer to FIG. 17, which is a side view of a first basketball imitation member 18' connected to the first arm member 34 according to another embodiment of the present invention. As shown in FIG. 17, the first basketball imitation member 18' could preferably be a hemispherical adaptor pivotally connected to the first arm member 34 (preferably by a rotating bearing 35 to make the hemispherical adaptor horizontally rotatable relative to the first arm member 34). As such, the user can lift a training basketball imitation member (e.g. the first basketball imitation member 18 as shown in FIG. 15) by his shooting hand 11 to match with the hemispherical adaptor, so as to guide the user to move his shooting hand 11 at the right shooting position precisely.

Figure 18:
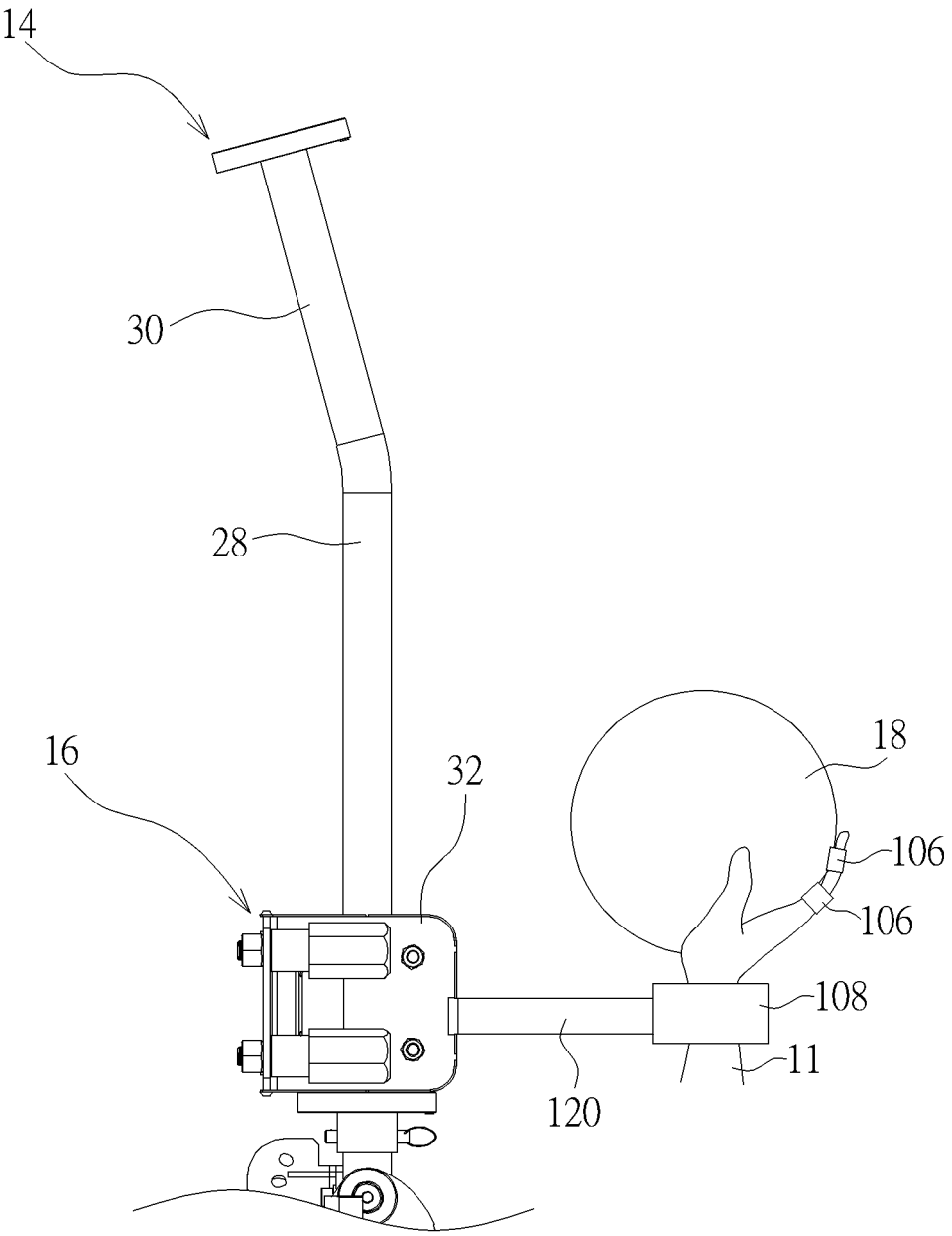
FIG. 18 is a side view of a wrist attachment device being connected to a resilient connector according to another embodiment of the present invention.

Moreover, as shown in FIG. 18, which is a side view of a wrist attachment device 108 being connected to a resilient connector 120 (e.g. a spring or rubber bar), the wrist attachment device 108 (preferably a wristband, but not limited thereto) is connected to the first base member 32 via the resilient connector 120, so as to train the user to develop proper wrist motion and proper arm motion for shooting a basketball into a basket while the user attaches his wrist to the wrist attachment device 108 and then lifts the first basketball imitation member 18 by his shooting hand.

Figure 19:
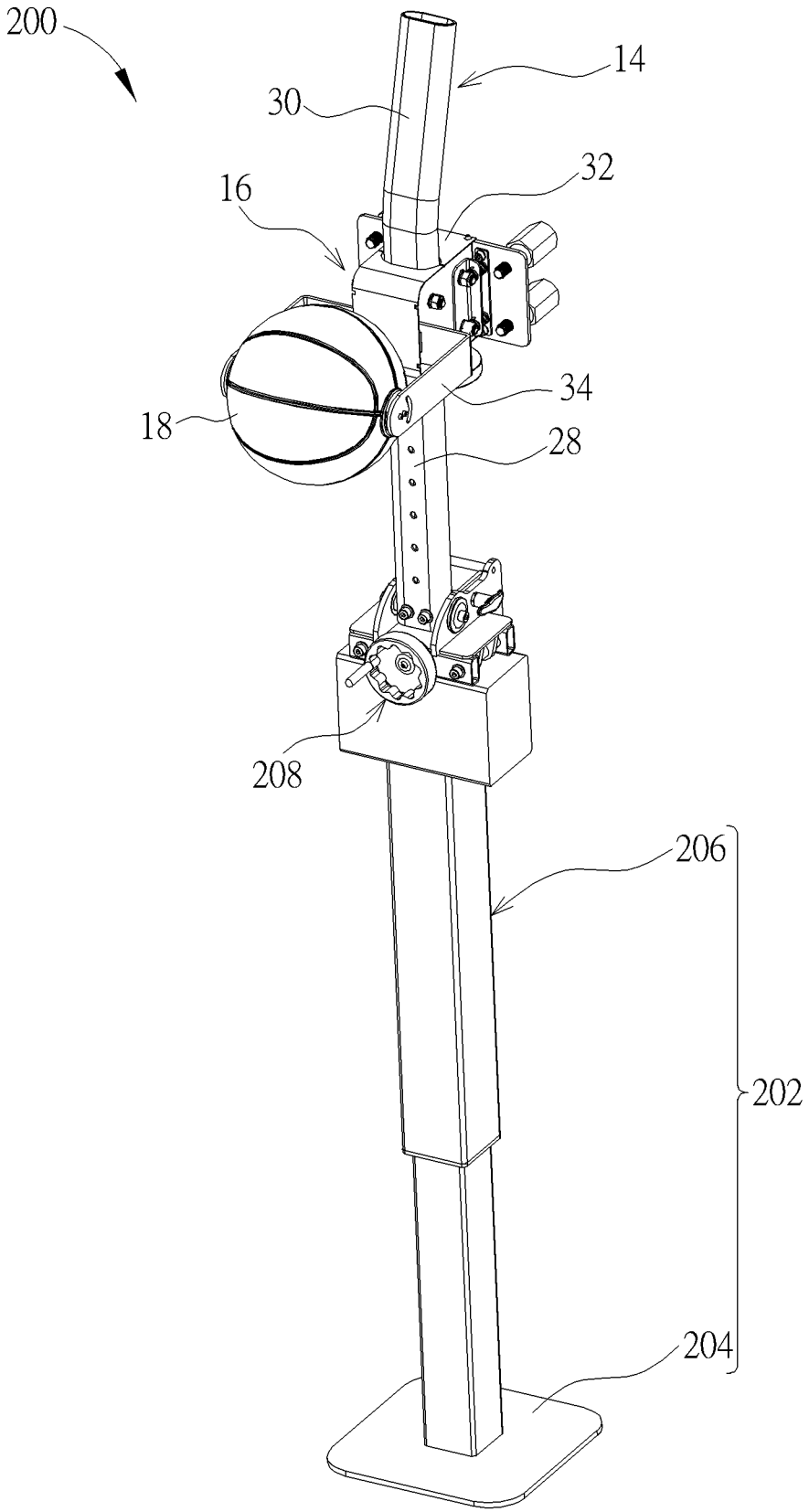
FIG. 19 is a diagram of a basketball shooting training device according to another embodiment of the present invention.

Besides, the main frame design is not limited to the aforesaid embodiments for simplifying the structural design of the main frame. For example, please refer to FIG. 19, which is a diagram of a basketball shooting training device 200 according to another embodiment of the present invention. Components both mentioned in this embodiment and the aforesaid embodiments represent components with similar structures or functions, and the related description is omitted herein. As shown in FIG. 19, the basketball shooting training device 200 includes the main frame 202, the first vertical rail structure 14, the first sliding base 16, and the first basketball imitation member 18. In this embodiment, the main frame 202 includes a bottom plate 204 and a telescopic rod 206. The bottom plate 204 is used for standing on a holding plane (such as a ground plane) so that the basketball shooting training device 200 could be placed steadily on the holding plane for a user (e.g. a basketball player) to operate conveniently. The telescopic rod 206 is telescopically connected to the first vertical rail structure 14 and the bottom plate 204 for adjusting the first basketball imitation member 18 to a desired height (e.g. the first basketball imitation member 18 could be adjusted to be aligned with a user's forehead or nose). Furthermore, in this embodiment, the present invention could further utilize a wheel handle device 208 to be connected to the first vertical rail structure 14 and the telescopic rod 206. In such a manner, the user can rotate the wheel handle device 208 to drive the first vertical rail structure 14 to move forward and rearward relative to the main frame 202 for conveniently adjusting the first basketball imitation member 18 to a proper position according to his body type. As for the related description for the telescopic structural design of the telescopic rod 206 and the driving mechanical design of the wheel handle device 208, it is commonly seen in the prior art and omitted herein.

Those skilled in the art will readily observe that numerous modifications and alterations of the device and method may be made while retaining the teachings of the invention. Accordingly, the above disclosure should be construed as limited only by the metes and bounds of the appended claims.

What is claimed is:

1. A basketball shooting training device comprising:

a main frame for standing on a holding plane;

a first vertical rail structure disposed on the main frame, the first vertical rail structure having a vertical rail and an oblique rail, wherein the oblique rail is connected to a top end of the vertical rail;

a first sliding base having a first base member and a first arm member, the first base member jacketing the first vertical rail structure and slidably contacting a first side of the first vertical rail structure for sliding along the first vertical rail structure, the first arm member extending from an outer edge of the first base member; and a first basketball imitation member connected to the first arm member, the first side of the first vertical rail structure facing the first basketball imitation member;

wherein when the first basketball imitation member is propped and then propelled upwardly by a user's hand, the first base member slides from a first initial position on the vertical rail to a shooting position on the oblique rail and keeps contacting the vertical rail without pivoting relative to the vertical rail to make the first basketball imitation member move straightly and upwardly along the vertical rail and then move straightly and obliquely along the oblique rail when the first base member slides along the first vertical rail structure for guiding the user's hand to complete a set shot along the first vertical rail structure.

2. The basketball shooting training device of claim 1, wherein the main frame has a transverse frame portion and a standing frame portion for standing on the holding plane, the transverse frame portion is connected to the standing frame portion, and the first vertical rail structure is disposed on the transverse frame portion.

3. The basketball shooting training device of claim 2 further comprising:

a second vertical rail structure spaced apart from the main frame and connected to the standing frame portion; and a torso attachment member slidably disposed on the second vertical rail structure for attaching to the user's torso so as to guide the user's torso to move vertically from a knee bending position to the first initial position along the second vertical rail structure during a period that the first basketball imitation member is propelled from the knee bending position to the first initial position upwardly.

4. The basketball shooting training device of claim 2, wherein the main frame further has a standing base extending laterally from the standing frame portion.

5. The basketball shooting training device of claim 2 further comprising:

a torso attachment member; and a pulley transmission device comprising:

a pulley assembly connected to the transverse frame portion and the torso attachment member to make the transverse frame portion and the torso attachment member move together via transmission of the pulley assembly; and a pulling force applying device connected to the pulley assembly for providing a pulling force.

6. The basketball shooting training device of claim 1, wherein an arm guide base is disposed on the first side of the first vertical rail structure and located under the first sliding base, and the arm guide base has two guide sheets spaced apart thereon for constraining the user's lower arm put therebetween at the same vertical plane with the user's upper arm.

7. The basketball shooting training device of claim 6, wherein the two guide sheets are movably disposed on the arm guide base and the first vertical rail structure is movable leftward and rightward and pivotable forward and rearward relative to the transverse frame portion for adjusting positions of the two guide sheets relative to the user so as to align the user's lower arm with the user's upper arm at the same vertical plane.

8. The basketball shooting training device of claim 1, wherein the first basketball imitation member is rotatably connected to the first arm member for allowing the user's fingers to rotate the first basketball imitation member at a specific angle when the first base member slides to the shooting position on the oblique rail, so as to make the user's fingers complete a follow-through motion.

9. The basketball shooting training device of claim 1 further comprising:

a second sliding base having a second base member and a second arm member, the second base member being slidably disposed on a second side of the first vertical rail structure opposite to the first base member for sliding along the first vertical rail structure, the second arm member extending from the second base member; and a second basketball imitation member connected to the second arm member;

wherein when the second basketball imitation member is propped and then propelled upwardly by the user's hand, the second base member slides from a second initial position on the vertical rail to a hooking position on the oblique rail for guiding the user's hand to complete a hook shot along the first vertical rail structure.

10. The basketball shooting training device of claim 9, wherein the second basketball imitation member is rotatably connected to the second arm member for allowing the user's fingers to rotate the second basketball imitation member at a specific angle when the second base member slides to the hooking position on the oblique rail, so as to make the user's fingers complete a follow-through motion.

11. The basketball shooting training device of claim 1 further comprising:

a braking device disposed on the first sliding base for braking the first sliding base when the first base member slides from the shooting position on the oblique rail back to the first initial position on the vertical rail due to the weight of the first basketball imitation member.

12. The basketball shooting training device of claim 11, wherein the first sliding base is pivoted to the first vertical rail structure, the braking device comprises a bending arm and a braking pad, the bending arm extends from the first base member, the braking pad is disposed at a bottom end of the bending arm, the first sliding base pivots relative to the first vertical rail structure cooperatively with the bending arm due to the weight of the first basketball imitation member to make the braking pad contact with the first vertical rail structure for stopping the first sliding base at the first initial position when the first basketball imitation member is not propped, and the first sliding base pivots relative to the first vertical rail structure cooperatively with the bending arm to make the braking pad separate from the first vertical rail structure when the first basketball imitation member is propelled upwardly by the user's hand.

13. The basketball shooting training device of claim 1, wherein the oblique rail is pivoted to the top end of the vertical rail for adjusting an oblique angle of the oblique rail relative to the vertical rail.

14. The basketball shooting training device of claim 1, wherein the main frame comprises a telescopic rod and a bottom plate for standing on the holding plane, and the telescopic rod is telescopically connected to the first vertical rail structure and the bottom plate for adjusting a height of the first basketball imitation member.

15. The basketball shooting training device of claim 1 further comprising:

at least one finger attachment device movably disposed on the first basketball imitation member.

16. The basketball shooting training device of claim 15, wherein a linear guide rail is formed on the first basketball imitation member, and the finger attachment device has a sliding block slidably disposed in the linear guide rail.

17. The basketball shooting training device of claim 15, wherein at least one arc-shaped guide rail is formed on the first basketball imitation member, and the finger attachment device is slidable along the arc-shaped guide rail.

18. The basketball shooting training device of claim 1 further comprising:

a wrist attachment device movably disposed on the first basketball imitation member.

19. The basketball shooting training device of claim 1, wherein the first sliding base further has a limiting rod pivotally connected to the first arm member, and the limiting rod penetrates into the first basketball imitation member via a limiting slot of the first basketball imitation member and is pivotally connected to the first basketball imitation member for limiting rotation of the first basketball imitation member.

20. The basketball shooting training device of claim 1, wherein the first basketball imitation member is a hemispherical adaptor, and the hemispherical adaptor is pivotally connected to the first arm member for matching with a training basketball imitation member.

* * * * *